US009153367B2

(12) United States Patent
Armijo

(10) Patent No.: US 9,153,367 B2
(45) Date of Patent: Oct. 6, 2015

(54) METHOD OF MAKING MAGNETIC IRON NITRIDE NANOPARTICLES

(71) Applicant: Leisha M. Armijo, Albuquerque, NM (US)

(72) Inventor: Leisha M. Armijo, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 0 days.

(21) Appl. No.: 13/987,912

(22) Filed: Sep. 16, 2013

(65) Prior Publication Data

US 2014/0079621 A1 Mar. 20, 2014

Related U.S. Application Data

(60) Provisional application No. 61/701,261, filed on Sep. 14, 2012.

(51) Int. Cl.

| | |
|---|---|
| ***H01F 1/01*** | (2006.01) |
| ***H01F 1/06*** | (2006.01) |
| ***H01F 1/00*** | (2006.01) |

(52) U.S. Cl.

CPC ..... *H01F 1/01* (2013.01); *H01F 1/065* (2013.01); *H01F 1/0045* (2013.01)

(58) Field of Classification Search

None

See application file for complete search history.

(56) References Cited

U.S. PATENT DOCUMENTS

| | | | | |
|---|---|---|---|---|
| 2005/0208320 | A1* | 9/2005 | Masada et al. | 428/570 |
| 2009/0252991 | A1* | 10/2009 | Ishikawa et al. | 428/800 |
| 2011/0059005 | A1* | 3/2011 | Sankar et al. | 423/409 |
| 2013/0089740 | A1 | 4/2013 | Burdinski et al. | 428/402 |

FOREIGN PATENT DOCUMENTS

JP 2006344981 A * 12/2006

OTHER PUBLICATIONS

Bronstein et al.; Influence of Iron Oleate Complex Structure on Iron Oxide Nanoparticle Formation; Chem. Mater.; 19, 3624-3632; 2007.*

Christoph Alexion et al., Targeting cancer cells: magnetic nanoparticles as drug carriers, Eur Biophys, 35: 446-450 Jan. 2006.

W.C. Dewey, Interaction of Heat with Radiation and Chemotherapy, Cancer Research (Supp) 44, 4714s-4720 Oct. 1984.

M. Johannsen e et al., Morbity and quality of life during thermotherapy using magnetic nanoparticles in locally recurrent prostrate cancer: Results of a prospecitve phase I trail, Int. J. Hydrotherapy, 23(3) 315-323 May 2007.

Klaus Maier-Hauff et al., Efficacy and safety of intratumoral thermotherapy using magnetic iron-oxide nanoparticles combined with external beam radiotherapy on patients with recurrent glioblastoma mutliform, J. Neurooncol 103:317-324 Sep. 2011.

Dar-Bin Shieh et al., Aqueous dispersions of magnetic nanopaarticle with $NHR_3^+$ surfaces for magnetic manipulation of biomolecules and MRI contrast agents, Biomaterials 26, 7183-7191, Jun. 2005.

Marcel De Cuyper et al., Assessing iron oxide nanoparticle toxicity in vitro: current status and future porspects, Nanomedicine 5.8 1261, Oct. 2010.

(Continued)

*Primary Examiner* — Guinever S Gregorio

(57) ABSTRACT

Magnetic iron nitride nanoparticles, such as $Fe_{16}N_2$ nanoparticles, are made by subjecting iron nanoparticles synthesized from iron oxide or iron carbonyl precursor to a solid-gas reaction with a nitrogen-containing gas.

9 Claims, 2 Drawing Sheets

(56) References Cited

OTHER PUBLICATIONS

Stefaan J.H. Soenen et al., Intracellular Nanoparticle Coating Stability Determines Nnaoparticle Diagnostics Efficacy and Cell Functionality, Small 6, No. 19, 2136-2145, 2010.

Omid Veiseh et al., Optical and MRI Multifunctional Nanoprobe for Targeting Gliomas, Nano Letters, Vo. 5, No. 6, 1003-1008, Mar. 2005.

Willaim Fuller Brown, Thermal Fluctuations of a Single-Domain Particle, Physical Review, vol. 130, No. 5, 1 1677-1686, Jun. 1963.

Jongnam Park et al., Ultra-large-scale synthesis of monodisperse nanocrystals, nature materials, vol. 3, 891-895, Dec. 2004.

Lyudmila M. Bronstein et al., Influence of Irom Oleate Complex Structure on Iron Oxide Nanoparticle Formation, Chem. Mater. 19, 3624-3632, Jun. 2007.

Leisha M. Armijo et al., Iron Oxide for Magnetic Hyperthermia Applications, nanomaterials 2, 134-146, May 2012.

* cited by examiner

METHOD OF MAKING MAGNETIC IRON NITRIDE NANOPARTICLES

RELATED APPLICATION

This application claims benefits and priority of U.S. provisional application Ser. No. 61/701,261 filed Sep. 14, 2012, the entire disclosure of which is incorporated herein by reference.

FIELD OF THE INVENTION

The present invention relates to a method of making magnetic iron nitride nanoparticles, such as magnetic $Fe_{16}N_2$ nanoparticles.

BACKGROUND OF THE INVENTION

Iron nitride magnets offer a low cost alternative to rare earth magnets. In addition, the questionable stability of rare earth magnets on the nanoscale is avoided in the binary iron phases.

It has been shown that the low nitrogen content phases such as $\gamma$-$Fe_4N$, $\epsilon$-$Fe_{2-3}N$, $\alpha'$-$Fe_8N$ and $\alpha''$-$Fe_{16}N_2$ are ferromagnetic compounds having exceptionally well characterized stoichiometry and electronic properties and are attractive compounds for magnetic functional nanomaterials. The synthetic routes for commercial production are also well-documented.

Ferromagnetic materials exhibit parallel alignment of moments resulting in large net magnetization even in the absence of a magnetic field. In particular, $\alpha''$-$Fe_{16}N_2$ phase is the most important compound and can be a possible candidate for high-density magnetic recording media owing to its very high magnetic moment, which is even larger than that of the pure $\alpha$-Fe. The saturation magnetization and the coercivity of these ferromagnetic phases for iron thin films have been studied by many researchers, since the saturation magnetization is an intrinsic property of materials. Except for the phases of a-$Fe_8N$ and $\alpha''$-$Fe_{16}N_2$, the saturation magnetization of the other ferromagnetic phases is generally lower than that of the a-Fe, which has been proven by most above-mentioned researchers.

These iron nitride nanoparticles can find applications in magnetic memory devices, medical hyperthermia, magnetic drug carriers, and the like. For example, colloidal suspensions of magnetic nanoparticles (MNPs) called ferrofluids have been proposed for a range of biomedical applications such as magnetic gradient-guided drug carriers for targeted drug delivery, cancer thermotherapy, and MRI contrast agents. In thermotherapy, the response of MNPs to AC magnetic field causes thermal energy to be dissipated into the surroundings, killing the tumor cells. Additionally, hyperthermia enhances radiation and chemotherapy treatment of cancer.

Magnetic hyperthermia results from domain switching upon AC EM radiation application. Our previous work investigated iron oxide nanoparticles for heating applications, however, the major mechanism involved in the temperature increases in this particular nanomaterial has, only now, been uncovered. Such applications require a material with a large magnetic moment as well as control of the magnetic properties imparted by superparamagnetism. Therefore, iron-containing nanomaterials with high saturation magnetic moments are attractive. The iron oxides, specifically, have demonstrated high biocompatibility and low systemic toxicity. Others have reported the efficacy of tumor therapy using similar particles and found that the side effects of this therapeutic approach were moderate, and no serious complications were observed. Iron oxide nanoparticles have received FDA approval for use in humans as contrast agents in magnetic resonance imaging (MRI). Superparamagnetic iron oxide nanoparticles (SPIONs) hold potential as drug carriers, since they may be guided (and potentially removed when no longer needed) by the magnetic field toward a specific area of interest, thereby reducing the present effective dose and eliminating systemic side-effects. It is anticipated that other inorganic magnetic materials having higher saturation magnetizations may be of interest as drug carriers, however due to the low $LD_{50}$ of cobalt and the unknown in vivo biocompatibility of the rare earth elements, iron nitride is an alternative.

There is a need for a better method of manufacturing magnetic iron nitride nanoparticles, especially magnetic $Fe_{16}N_2$ nanoparticles.

SUMMARY OF THE INVENTION

The present invention provides a method to this end that includes subjecting iron nanoparticles to a solid-gas phase reaction using a nitrogen-containing gas to form magnetic iron nitride nanoparticles, such as magnetic $Fe_{16}N_2$ nanoparticles. The method can use iron oxide or an iron carbonyl as a precursor for forming the iron nanoparticles that are subjected to the nitrogen-containing gas.

An illustrative embodiment for making magnetic $Fe_{16}N_2$ nanoparticles comprises reducing iron oxide nanoparticles using a reducing agent such as hydrogen gas, $NaBH_4$, LiAlH, or urea to form iron nanoparticles, and then forming $Fe_{16}N_2$ nanoparticles by a solid-gas phase reaction of the iron nanoparticles with a nitrogen-containing gas.

A particularly illustrative embodiment involves heating iron oleate complex in the presence of oleic acid in a heated organic solvent to produce iron oxide nanoparticles as a precursor, then reducing the iron oxide nanoparticles by a solid-gas phase reaction using a reducing gas to form iron nanoparticles, and then forming iron nitride nanoparticles by a solid-gas phase reaction of the iron nanoparticles with a nitrogen-containing gas. An additional step may be used to cap the iron nitride nanoparticles with a polymer, such as PEG (polyethylene glycol).

Still another illustrative embodiment provides magnetic $Fe_{16}N_2$ nanoparticles using an iron carbonyl in an alcohol with sonication for a time to form iron nanoparticles by particle self-assembly, and then forming iron nitride nanoparticles by a solid-gas phase reaction of the iron nanoparticles with a nitrogen-containing gas.

The present invention is advantageous to produce magnetic iron nitride nanoparticles, especially magnetic $Fe_{16}N_2$ nanoparticles, in high yields wherein the nanoparticles have good oxidation resistance, high blocking temperatures, and control of particle morphology. Other advantages of the present invention will become more apparent from the following detailed description taken with the following drawings.

DETAILED DESCRIPTION OF THE INVENTION

Figure 1:
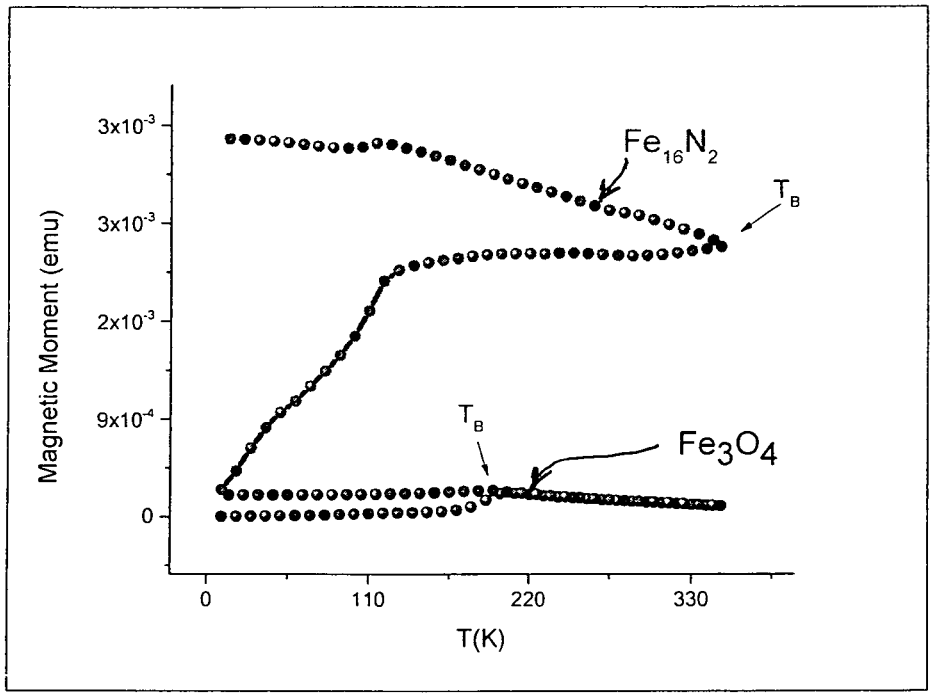
FIG. 1 shows a temperature sweep for samples of $Fe_3O_4$ nanoparticles and $Fe_{16}N_2$ nanoparticles measured at 293 K showing blocking temperatures.

The present invention provides a method for making magnetic iron nitride nanoparticles, such as especially magnetic $Fe_{16}N_2$ nanoparticles, wherein the nanoparticles have good oxidation resistance, high blocking temperatures, control of particle morphology, and can be produced with high yields. One embodiment of the invention involves using iron oxide nanoparticles as a precursor to produce iron nanoparticles and subjecting the iron nanoparticles to a solid-gas phase reaction step to produce the magnetic iron nitride nanoparticles. Another embodiment of the invention involves using an iron carbonyl as a precursor to produce iron nanoparticles and subjecting the iron nanoparticles to a solid-gas phase reaction step to produce the magnetic iron nitride nanoparticles. Magnetic $Fe_{16}N_2$ nanoparticles having a sphere diameter of 10 nm to 50 nm can be made.

In an illustrative embodiment of the invention for making magnetic $Fe_{16}N_2$ nanoparticles, the method involves heating iron oleate complex (made by a "green" process) in the presence of oleic acid in a heated organic solvent to produce iron oxide nanoparticles as a precursor, reducing the iron oxide nanoparticles to alpha iron nanoparticles at a superambient temperature by a solid-gas phase reaction using hydrogen gas or other reducing gas, and then forming iron nitride nanoparticles by a solid-gas phase reaction of the alpha iron nanoparticles at a superambient temperature with substantially oxygen-free ammonia gas or other nitrogen-containing gas. The magnetic $Fe_{16}N_2$ nanoparticles can be optionally capped with a polymer, such as PEG (polyethylene glycol).

Colloidal iron oxide nanoparticles also can be reduced by a reducing agent followed by reaction of the thus-reduced iron nanoparticles (non-colloidal nanoparticles) with ammonia gas or other substantially oxygen-free nitrogen-containing gas in another embodiment.

For purposes of illustration and not limitation, the reducing agent can include, but is not limited to, hydrogen gas, $NaBH_4$, LiAlH, urea or others of high purity (e.g. greater than 0.001% purity).

In still another illustrative embodiment for making magnetic $Fe_{16}N_2$ nanoparticles, the method involves providing iron carbonyl in a medium molecular weight alcohol with sonication for a time to form iron nanoparticles by particle self-assembly, and then forming iron nitride nanoparticles by a solid-gas phase reaction of the iron nanoparticles with a nitrogen-containing gas, such as ammonia gas. The iron carbonyl preferably is iron pentacarbonyl although other iron carbonyls formed by reaction of metallic iron and carbon monoxide may be used The following examples are offered to further illustrate, but not limit, practice of method embodiments pursuant to the invention.

Example 1

Synthesis of Colloidal Nanoparticles

An illustrative synthesis procedure comprises the following steps: synthesis of the iron oleate precursor complex, synthesis of the iron oxide nanoparticles as a precursor using the iron oleate precursor complex, and synthesis of $Fe_{16}N_2$ nanoparticles using two subsequent solid-gas phase reactions pursuant to embodiments of the present invention wherein the nanoparticles can be optionally capped with PEG to aid in dispersion. Practice of this example of the invention involves the synthesis of the iron oleate precursor complex since it is not currently commercially available. However, the synthesis of the complex can be omitted if a suitable iron oleate complex becomes commercially available in the future.

Materials:

Iron(III)chloride hexahydrate ($FeCl_3.6H_2O$, 97%), pyridine (anhydrous, 99.8%), methylated polyethylene glycol (mPEG) 5000 powder was purchased from (average mw≈5000 kDa), and succinic anhydride (>99%) were was purchased from Sigma-Aldrich, n-docosane (99%) and n-eicosane (99%) were purchased from Alfa Aesar, n-dodecane (>99%) was purchased from Fisher Scientific, sodium oleate salt [sodium (9Z)-9-octadecenoate, >97%) was purchased from Tokyo Chemical Industry Co. UHP ammonia gas and UHP hydrogen gas were purchased from Matheson Tri-Gas. All chemicals were used as received, without purification.

Those skilled in the art will appreciate that the above-described specific materials are identified and used for purposes of illustration and not limitation since other equivalent materials can be employed in practice of the method of the present invention.

Synthesis of Iron Oleate Precursor Complex

The precursor was iron oleate, consisting of at least two coordination modes (Fe2+di[(9Z)-9-octadecenoate] and Fe3+tri[(9Z)-9-octadecenoate]); $C_{36}H_{66}FeO_4$, which is routinely produced according to Park J, Ahn K, Hwang Y, Park J-G, Noh J-H, Kim J-Y, Park J-H, Hwang N-M and Hyeon T 2004 Ultra large scale synthesis of monodisperse nanocrystals *Nature Materials* 3 891-5, the teachings of which are incorporated herein by reference.

In particular, the iron oleate complex was formed from the combination of sodium (9Z)-9-octadecenoate and $FeCl_3.6H_2O$ by a green chemistry method. In the reaction, 25 mmol (6.75 g) of $FeCl_3.6H_2O$ were combined with 25 mL of deionized (DI) water and vacuum filtered through 0.22 μm filter paper. The mixture was then combined with 80 mmol (24.35 g) of sodium oleate in a three-neck round bottom flask. 150 mL of a stock solution consisting of a 2:4:6 mixture of deionized water, ethanol, and hexane was added to the flask. Under argon flow, the mixture was vented and filled with argon for three one-minute intervals to remove all oxygen from the reaction flask. The solution was slowly (5° C./min) heated to 50° C. under vigorous stirring. Once the solid sodium oleate salt had completely melted and the reflux had begun (around 50-60° C.), the temperature was further increased (3° C./min) to 70° C. and kept for four hours, ensuring that the total reflux time was 4 hours. The mixture was then cooled to 60° C. and washed three times with a 1:1 mixture of hexane and DI water in a separatory flask. The organic layer containing iron oleate was placed in a rotary evaporator (Cole Parmer Buchi R114 evaporator) with the water bath set at 30° C., until the hexane and ethanol were evaporated away. Additional hexane/acetone washes ensured the purity of the complex. The resulting waxy substance was then dried in a vacuum oven for 72 hours. The final product was a dark brown solid.

Synthesis of Iron Oxide Nanoparticles

Iron oxide (e.g. magnetite) nanoparticles are produced by reaction using 14.8 mmol (5 g) of iron oleate were combined with 1.6 mL (5.0 mmol) of oleic acid and 13.15 g (46.5 mmol) of n-docosane solvent (boiling point 370° C.) wherein the docosane (or other alkane solvent) is selected to provide a desired reaction temperature. The mixture was slowly (3° C./min) heated to 50° C. under argon flow and vigorous stirring. Once the reactants had dissolved, the temperature was further increased to 370° C., with a heating rate of 3.0° C./min. To produce 20 nm diameter particles (±1.4 nm), the mixture was allowed to reflux for 30 minutes. For larger nanoparticles, the reflux time may be extended with an average growth rate of 1.6 nm/min Synthesis of Iron Nitride $Fe_{16}N_2$ Nanoparticles Iron nitride nanoparticles (NP's) are produced using iron oxide nanoparticles as a precursor. The oleic acid coating is removed from the iron oxide nanoparticles from the previous step by adding 1M solution of hydrochloric acid, drop-wise until the carboxyl group of the oleic acid is protonated, and detaches from the nanoparticles. The uncapped iron oxide nanoparticles are isolated using standard methanol and hexanes extraction.

After drying under air, the iron oxide powder sample is reduced under flowing (e.g. 20 cc/minute) UHP hydrogen gas (as-received from Matheson Tri-Gas) overnight (e.g. 2-24 hours) at 320° C. in a three-neck, round-bottom flask (150 mL) in which the iron oxide powder is placed. One neck of the flask receives a thermocouple to monitor the reaction temperature. The other two necks function as a hydrogen gas inlet and gas outlet, respectively, with the gas outlet connected to a water bubbler. The flask is sealed in a manner that the interior is free of air. The round-bottom flask rests on a hearing mantel (heater) that is set to the desired reaction temperature (320° C. typically in the range of 250-400° C.) to heat the iron oxide powder to a desired superambient reaction temperature. The superambient reduction temperature is chosen to reduce the time to effect complete reduction of the iron oxide nanoparticles. Those skilled in the art will appreciate that other reducing agents can be used in this method step wherein the other reducing agents can include, but are not limited to, $NaBH_4$, LiAlH, urea, and other reducing agents using temperature, time, and flow rate parameters selected for the particular reducing agent used to achieve reduction of the iron oxide nanoparticles to alpha-iron nanoparticles.

Then, the alpha-iron powder sample is exposed to flowing (e.g. 20-50 cc/minute) ultra-high purity (UHP) ammonia gas (as-received from Matheson Tri-Gas) overnight (e.g. 2-24 hours) at a temperature of 250° C. in a three-neck, round-bottom flask (150 mL) in which the iron powder is placed to form magnetic $Fe_{16}N_2$ nanoparticles A reaction temperature in the range of 250-400° C. is preferred since if the synthesis temperature is higher than 400° C., the phases of $\gamma$-$Fe_4N$ and $\epsilon$-$Fe_3N$ can appear, whose saturation magnetizations are lower than that of $\alpha$-Fe.

The alpha-iron powder sample is reacted with ammonia gas in a three-neck, round-bottom flask (150 mL) in a manner similar to that described above for the hydrogen reduction step. One neck of the flask receives a thermocouple to monitor the reaction temperature. The other two necks function as an ammonia gas inlet and gas outlet, respectively, with the gas outlet connected to a water bubbler. The flask is sealed in a manner that the interior is free of air. The round-bottom flask rests on a hearing mantel (heater) that is set to the desired reaction temperature (250° C. typically in the range of 250-400° C. for 2 to 24 hours) to heat the iron powder to a desired superambient reaction temperature for reaction with the UHP ammonia gas. The superambient reaction temperature/time with UHP ammonia may be chosen to reduce the time to effect transformation of the iron nanoparticles to $Fe_{16}N_2$ nanoparticles Those skilled in the art will appreciate that other nitrogen-containing gases can be used in this method step using temperature, time, and flow rate parameters selected for the particular nitrogen-containing gas used to achieve formation of the iron nitride nanoparticles.

Polyethylene Glycol Succinylation.

Succinylated PEG was produced from the PEG-OH terminal of mPEG, in a process during which the terminal hydroxyl group was converted to a more electronegative carboxyl group, thus enhancing binding affinity and colloidal stability. In order to keep a sealed pyridine bottle under close to atmospheric pressure, 25 mL of nitrogen gas were drawn up into a syringe through the septum of a nitrogen-filled three-neck flask connected to the Schlenk line, and injected into the pyridine bottle. After injection, 25 mL of anhydrous pyridine were drawn up from the bottle and injected into the nitrogen-filled flask. The temperature controller was set to 50° C., the temperature at which the solid mPEG dissolves. Subsequently, 2.5 g of succinic anhydride were added to the three-neck flask. This reaction process lasted for one hour at 50° C. The addition of pyridine was repeated four more times using the same methodology as described above and the reaction was allowed to continue for another 2 hours at 50° C. Pyridine was then removed using three DI water washes using the rotary evaporator. The material was then re-dissolved in water and placed in 1 kDa cutoff dialysis tubing in a 1 L beaker of DI water. The DI water in the 1 L beaker was replaced after 2, 4, and 8 hours.

PEG Capping of Nanoparticles.

The magnetic iron nitride nanoparticles come out of synthesis described above capped with oleic acid. The oleic acid was removed with an acid wash, in which the carboxyl groups of the oleic acid became protonated, and thus liberated. Succinylated PEG having an average molecular weight of 5000 Da was used for capping of nanoparticles. A PEG to nanoparticle mass ratio of 3:1 was used for the capping process, performed in chloroform at room temperature. Finally, the nanoparticles were sonicated to ensure complete coverage and form a colloidal solution.

Characterization of Colloidal Nanocrystals

Structural characterization of the nanocrystals was characterized using a JOEL 2010 TEM. For structural characterization, samples for transmission electron microscopy (TEM) were prepared by placing a drop of the colloidal solution onto a 200-mesh carbon-coated copper grid. The solvent was allowed to evaporate away, thus fixing the sample on the grid. The average particle size for the iron oxide sample was 15±1.6 nm as determined from TEM measurements. Agglomeration and interference with the electron beam did not permit TEM size distribution data to be collected from the iron nitride sample.

The NP phase and crystal structure were determined using a Rigaku Smartlab® X-Ray Diffractometer (XRD) with a Cu K$\alpha$ source (0.154 nm). The XRD data for iron oxide nanoparticles (not shown) suggest that the composition of the nanoparticles is more than 70% $Fe_3O_4$ with space group Fd3m. The remaining portions of the nanocrystalline material appear to be composed of $Fe_2O_3$ maghemite and FeO wüstite phases, although the oxidation state is difficult to determine with absolute certainty because of similar space groups and lattice constant values.

The iron nitride sample shows the presence of an $Fe_{16}N_2$ phase which would account for the high magnetic moment. The $Fe_{16}N_2$ phase had a body centered tetragonal (BCT) crystal structure pursuant to XRD and TEM.

Magnetic Characterization

The magnetic properties were measured by a Superconducting Quantum Interference Device (SQUID) magnetometer at a temperature range from 10-350 K. To measure the zero-field cooling (ZFC) and field-cooling (FC) magnetization curves, three steps were carried out as follows: First, nanoparticle samples were gradually cooled in a zero magnetic field from room temperature to 5 K; Then, a magnetic field of 100 Oe was applied to measure the ZFC magnetization curve in a warming process from 10-350 K; Last, the FC curve was measured in the same applied field in a cooling process from 350-10 K. The ZFC and FC magnetization curves were measured in magnetic fields of 100 Oe from 10-350 K, respectively.

FIG. 1 shows the temperature sweep for a $Fe_3O_4$ nanoparticle sample and $Fe_{16}N_2$ nanoparticle sample measured at 293 K showing respective blocking temperatures, $T_B$.

AC Susceptometry

Measurements were performed on the following samples:

I. Sample 1 which consisted of the base ferrofluid; colloidal suspension of magnetite ($Fe_3O_4$) particles of mean particle radius 15 nm in deionized water solvent, with succinylated PEG as a capping agent.

II. Sample 2 which consisted of a ferrofluid; colloidal suspension of martensite ($Fe_{16}N_2$) particles with a mean radius of 11 nm in deionized water solvent with succinylated PEG as a capping agent.

Measurements of the frequency-dependent volume susceptibility in the frequency range 1 Hz to 100 kHz were performed using the DynoMag® (IMEGO AB, Sweden), with a frequency range from 1 Hz to 200 kHz, a resolution magnetic moment of $3\times10^{-11}$ $Am^2$, and excitation amplitude of 0.5 mT. The ferrofluid samples I and II in water solvent at a concentration of 130 M was measured using a 200 μL sample. Susceptometry data verifies the magnetic hysteresis measurement in which we found that the both samples are superparamagnetic at room temperature. The susceptometry measurements demonstrate a single peak which we attribute to a Neel process in which $\tau_N=1.29\times10^{-6}$ ms.

Assuming the superparamagnetism, the Neel relaxation time of moment rotations activated by thermal fluctuation may be expressed as [11]:

$$\tau N=\tau_0\exp(K_u V/k_B T), \quad (3)$$

where $\tau_0$ is on the order of $10^{-9}$ s, V is the particle volume, $k_B$ is the Boltzmann constant and $K_u$ is an effective anisotropy energy barrier. For iron oxide $V=1.767\times10^{-24}$ $m^3$.

When $k_BT>K_uV$, the magnetic moment flips at a measured time, demonstrating zero coercivity. Presently, the effective anisotropy energy ($K_u$) of the iron oxide sample may be estimated to be $4.2\times10^5$ ergs/cc by the relation $K_uV=25k_BT_B$ (assuming $T_B$=215 K), higher than the $K_u$ of bulk $Fe_3O_4$ ($Ku=6.4\times10^4$) due to additional anisotropies.

The effective anisotropy energy of the iron nitride sample was calculated to be $5.6\times10^5$ ergs/cc. A reference value for bulk $Fe_{16}N_2$ is not presently available in the literature.

Figure 2A:
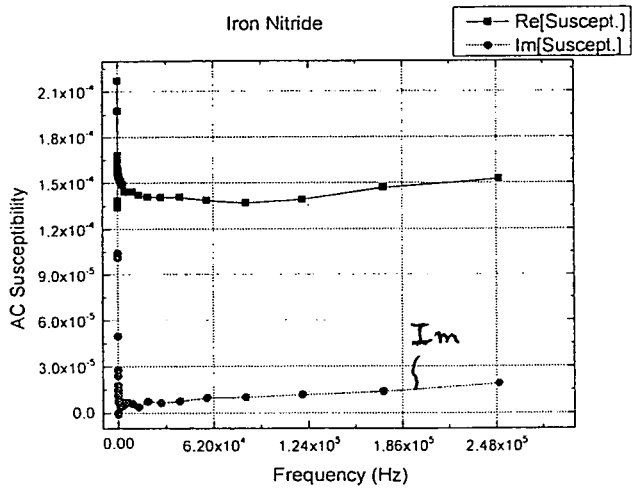
FIGS. 2A and 2B show the AC susceptibility of iron nitride-containing ferrofluid and iron oxide-containing ferrofluid as a reference, respectively, showing frequency-dependent volume susceptibility in the frequency range of 1 Hz to 100 KHz.
Figure 2B:
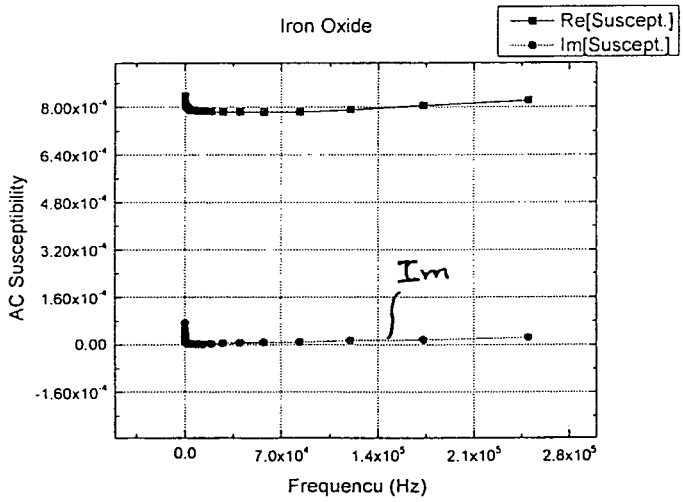

The real part of the susceptibility ($\chi'$) values for both samples are greater than zero; a typical feature of ferri/ferromagnetic materials. Despite this, the $\chi'$ value for iron nitride is two times higher than the value for iron oxide. FIGS. 2A and 2B show the AC susceptibility of iron nitride-containing ferrofluid and iron oxide-containing ferrofluid as a reference, respectively, showing frequency-dependent volume susceptibility in the frequency range of 1 Hz to 100 KHz.

The magnetic nanoparticle samples I and II are highly magnetic and monodisperse, with excellent crystallinity. The magnetite sample (I) exhibited excellent heating properties which we attribute to the dominant Neel process. Due to the presence of a single peak in AC susceptometry data, we can theorise that the particles are single domain. The iron nitrides hold promise as highly magnetic alternatives to the iron oxides and rare-earth elements as MRI contrast agents, magnetic drug carriers, and facilitators of medical hyperthermia. Due to the higher magnetic moment of $Fe_{16}N_2$, this material should exhibit high heating rates.

The astronomical saturation magnetization values of the iron nitrides is of interest for many applications. Additionally, the green chemistry method offers environmental benefits, as well as lower disposal costs, and risk to personnel. Both samples I and II have good stability over time and good resistance to oxidation despite passivation layer addition. The mechanisms of formation of the crystals allow both excellent monodispersity and crystallinity as well as the option to synthesize different morphologies as described in reference [6] listed herebelow, which is incorporated by reference herein.

Example 2

Synthesis of Iron Oleate Precursor Complex

Iron oleate complex was formed as follows. For example, 3.24 grams of $FeCl_3.6H_2O$ were combined with 12 mL of deionized (DI) water and stirred for 5 minutes for complete dissolution and then vacuum filtered through 0.22 μm filter paper. The mixture was then combined with 110.95 grams of sodium oleate in a three-neck round bottom reaction flask. 500 mL. Then, 24 mL of ethanol was added followed by 42 mL of hexane and then 12 ml of deionized water (DI) to provide a mixture of deionized water, ethanol, and hexane in the reaction flask, which is then closed off using a rubber septum. The mixture was heated to 70° C. and kept at 70° C. for 4 hours under argon flow. Then, the mixture was cooled to 50° C., and argon flow stopped. The mixture was then washed three times with 10-20 mL aliquots of DI water in a separatory funnel and allowed to separate into layers. The remaining hexane was evaporated away using a Rotovap evaporator set at 50-60° C. The waxy iron oleate complex was placed in a vacuum sealed container in an oven at 70° C. for 24 hours and stored for later use in a glass vial Synthesis of $Fe_3O_4/Fe_2O_3$ Nanocrystals Iron oxide (e.g. magnetite/hematite) nanocrystals (i.e. nanoparticles) are produced by reaction using 1.85 grams (2 mmol) of the iron oleate complex that were combined with 0.64 mL of oleic acid and 7.78 grams (10 mL) of n-docosane solvent (boiling point 370° C.) wherein the particular alkane solvent is selected to provide a desired reaction temperature. A thermocouple was inserted in the flask. The mixture was slowly heated to 60° C. under argon flow to allow the solvents to melt and allow the reactants to dissolve. Once the reactants had dissolved, the temperature was further increased to 370° C., with a heating rate of 3.3° C./min. under stirring and allowed to reflux for 3 minutes and then cooled to 50° C. and obtain iron oxide nanocrystals. The nanocrystals can be placed in a vial for long term storage in solid solvent without concerns of aggregation and oxidation. Or, for using the nanocrystals within the next week, add 10 ml:40 mL hexane; acetone mixture to the flask to precipitate the nanoparticles by centrifugation. Then, thoroughly wash the nanoparticles with hexane and acetone three times and disperse in chloroform and place in a glass vial.

Synthesis of Magnetic $Fe_{16}N_2$ Monodisperse Nanocrystals (23.4 nm Spheres)

Iron nitride nanoparticles are produced using the iron oxide nanoparticles as a precursor. The oleic acid coating is removed from the iron oxide nanoparticles from the previous step by adding 1M solution of hydrochloric acid, drop-wise until the carboxyl group of the oleic acid is protonated, and detaches from the nanoparticles. The uncapped iron oxide nanoparticles are isolated using the standard methanol and hexanes extraction. After drying under air, the powder sample is reduced under flowing UHP hydrogen gas at 200-500° C. for 10-24 hours (using about 20 cc/min hydrogen flow rate) to produce alpha-iron nanocrystals. For a 25 mL scintillation sample, 0.72 $ft^3$ of hydrogen gas is necessary for the complete reduction. The reduced sample is kept out of contact with air.

The reduction reaction was carried out in a three-neck, round bottom flask resting on a heating mantel as described above in Example 1.

Then, the iron nanocrystals sample is exposed to flowing UHP ammonia gas (flow rate of 20 cc/min) for 10-24 hours at a temperature of 150° C. for ammonolysis to form magnetic alpha-$Fe_{16}N_2$ nanoparticles. The reaction with UHP ammonia gas was carried out in a three-neck, round bottom flask resting on a heating mantel as described above in Example 1. The powder samples are stored in docosane or other solid solvent to prevent rapid oxidation.

Example 3

This example involves making magnetic $Fe_{16}N_2$ nanoparticles using iron pentacarbonyl in a medium molecular weight alcohol solvent at room temperature and pressure with sonication for a time to form iron nanoparticles by particle self-assembly. For example, an amount of iron pentacarbonyl is provided in isopropynal alcohol under air-free conditions followed by sonication for 5-50 minutes until the solution turns from yellow to black, indicating formation of iron nanoparticles by particle self-assembly. The medium molecular weight alcohol provides a solvent to allow the self-assembly of the zero-valent iron nanoparticles and can comprise any medium molecular weight alcohol. After separation form the alcohol and optional decapping as described above, the iron nanoparticles are then subjected at superambient temperature to nitrogen-containing gas, such as flowing UHP ammonia as described in Example 1, to form the magnetic iron nitride ($Fe_{16}N_2$) nanoparticles.

Although the present invention has been described above with respect to certain illustrative embodiments, those skilled in the art will appreciate that changes and modifications can be made therein within the scope of the present invention as set forth in the appended claims.

REFERENCES WHICH ARE INCORPORATED HEREIN BY REFERENCE

[1] Alexiou C, Schmid R J, Jurgons R, Kremer M, Wanner G, Bergemann C, Huenges E, Nawroth T, Arnold W and Parak F G 2006 Targeting cancer cells: magnetic nanoparticles as drug carriers *European biophysics journal* 35 446-50

[2] Dewey W C 1984 Interaction of Heat with Radiation and Chemotherapy *Cancer Research* 44 4714s-20s

[3] Johannsen M, Gneveckow U, Taymoorian K, Thiesen B, Waldöfner N, Scholz R, Jung K, Jordan A, Wust P and Loening S A 2007 Morbidity and quality of life during thermotherapy using magnetic nanoparticles in locally recurrent prostate cancer: Results of a prospective phase I trial *International journal of hyperthermia* 23 315-23

[4] Maier-Hauff K, Ulrich F, Nestler D, Niehoff H, Wust P, Thiesen B, Orawa H, Budach V and Jordan A 2011 Efficacy and safety of intratumoral thermotherapy using magnetic iron-oxide nanoparticles combined with external beam radiotherapy on patients with recurrent glioblastoma multiforme *Journal of neuro-oncology* 103 317-24

[5] Shieh D B, Cheng F Y, Su C H, Yeh C S, Wu M T, Wu Y N, Tsai C Y, Wu C L, Chen D H and Chou C H 2005 Aqueous dispersions of magnetite nanoparticles with $NH_3^+$ surfaces for magnetic manipulations of biomolecules and MRI contrast agents *Biomaterials* 26 7183-91

[6] Armijo L, Brandt Y, Mathew D, Yadav S, Maestas S, Rivera A, cook N, Withers N, Smolyakov G, Adolphi N, Monson T, Huber D, Smyth H and Osinski M 2012 Iron Oxide Nanocrystals for Magnetic Hyperthermia Applications *Nanomaterials* 2 134-46

[7] Soenen S J and De Cuyper M 2010 Assessing iron oxide nanoparticle toxicity in vitro: current status and future prospects *Nanomedicine* 5 1261-75

[8] Soenen S J H, Himmelreich U, Nuytten N, Pisanic Ii T R, Ferrari A and De Cuyper M 2010 Intracellular nanoparticle coating stability determines nanoparticle diagnostics efficacy and cell functionality *Small* 6 2136-45

[9] Veiseh O, Sun C, Gunn J, Kohler N, Gabikian P, Lee D, Bhattarai N, Ellenbogen R, Sze R and Hallahan A 2005 Optical and MRI multifunctional nanoprobe for targeting gliomas *Nano letters* 5 1003-8

[10] Brown, W F 1963 Thermal Fluctuations of a Single-Domain Particle *Journal of Applied Physics* 34 1319-20

[11] Park J, Ahn K, Hwang Y, Park J-G, Noh J-H, Kim J-Y, Park J-H, Hwang N-M and Hyeon T 2004 Ultra large scale synthesis of monodisperse nanocrystals *Nature Materials* 3 891-5

[12] Bronstein L M, Huang X, Retrum J, Schmucker A, Pink M, Stein B D and Dragnea B 2007 Influence of iron oleate complex structure on iron oxide nanoparticle formation *Chemistry of materials* 19 3624-32

[13] Zhang X, Chen S, Wang H-M, Hsieh S-L, Wu C-H, Chou H-H and Hsieh S 2010 Role of Neel and Brownian relaxation mechanisms for water-based $Fe_3O_4$ nanoparticle ferrofluids in hyperthermia *Biomedical Engineering: Applications, Basis and Communications* 22 393-9

I claim:

1. A method of making magnetic iron nitride nanoparticles, comprising reacting alpha iron nanoparticles with a nitrogen-containing gas that is substantially free of oxygen at a temperature in the range of 300 degrees C. to 400 degrees C. in an air-free reaction chamber to produce the magnetic iron nitride nanoparticles comprising $Fe_{16}N_2$ nanoparticles.

2. The method of claim 1 wherein the alpha iron nanoparticles are made by reducing iron oxide nanoparticles.

3. The method of claim 1 wherein the nitrogen-containing gas is ultra high purity ammonia gas.

4. A method for making magnetic iron nitride nanoparticles, comprising producing iron oxide nanoparticles by reacting iron oleate and oleic acid in a solvent, reducing the iron oxide nanoparticles by a reducing agent to form alpha iron nanoparticles, and then forming magnetic iron nitride nanoparticles by reacting the alpha iron nanoparticles with substantially oxygen-free ammonia gas at a temperature in the range of 300 degrees C. to 400 degrees C. in an air-free reaction chamber to produce the magnetic iron nitride nanoparticles comprising $Fe_{16}N_2$ nanoparticles.

5. The method of claim 4 wherein the alpha iron nanoparticles are dried in air prior to reacting with the substantially oxygen-free ammonia gas.

6. The method of claim 4 wherein the reducing agent comprises hydrogen gas, $NaBH_4$, or LiAlH.

7. The method of claim 4 wherein the ammonia gas is ultra high purity ammonia gas.

8. The method of claim 4 wherein the magnetic iron nitride nanoparticles comprise spheres.

9. The method of claim 4 wherein the iron oxide nanoparticles are produced with an oleic acid coating and wherein the coating is removed from the iron oxide nanoparticles by acid contact before the iron oxide nanoparticles are reduced to the alpha iron nanoparticles.

* * * * *